US005722185A

United States Patent [19]

Vigneron

[11] Patent Number: 5,722,185

[45] Date of Patent: Mar. 3, 1998

[54] HEATED SHOE WITH LONG HEATING TIME

[76] Inventor: Emilien Vigneron, 157 rue de la Roquette, 75011 Paris, France

[21] Appl. No.: 623,395

[22] Filed: Mar. 27, 1996

[30] Foreign Application Priority Data

Mar. 28, 1995 [FR] France ..... 95 03624

[51] Int. Cl.[6] ..... A43B 7/02; H05B 3/34

[52] U.S. Cl. ..... 36/2.6; 219/211

[58] Field of Search ..... 36/2.6, 137, 139; 219/211

[56] References Cited

U.S. PATENT DOCUMENTS

| | | | |
|---|---|---|---|
| 3,070,907 | 1/1963 | Rocco | 36/137 |
| 3,360,633 | 12/1967 | Weisberger | 219/211 |
| 3,906,185 | 9/1975 | Gross et al. | 36/2.6 |
| 3,977,093 | 8/1976 | Santroch | 36/2.6 |
| 4,665,301 | 5/1987 | Bondy | 219/211 |
| 4,798,933 | 1/1989 | Annovi | 36/2.6 |
| 4,894,931 | 1/1990 | Senee et al. | 36/2.6 |
| 4,948,951 | 8/1990 | Balzano | 219/211 |
| 5,367,788 | 11/1994 | Chen | 36/3 B |

FOREIGN PATENT DOCUMENTS

| | | | |
|---|---|---|---|
| 0315004 | 10/1988 | European Pat. Off. . | |
| 722487 | 9/1931 | France . | |
| 1164720 | 1/1957 | France . | |
| 2365973 | 4/1976 | France | 36/2.6 |
| 2757855 | 7/1979 | Germany | 36/2.6 |
| 3323062 | 5/1984 | Germany . | |
| 2054348 | 2/1981 | United Kingdom | 36/2.6 |

*Primary Examiner*—M. D. Patterson

*Attorney, Agent, or Firm*—Sixbey, Friedman, Leedom & Ferguson, P.C.; Gerald J. Ferguson, Jr.

[57] ABSTRACT

A heated shoe comprising a heel, a sole provided with a heating device and having an outside face for making contact with the ground, and at least one energy-providing battery located in the heel and connected to the heating device. The heating device comprises a heating film or cloth extending over at least a portion of the sole parallel to its outside face. The sole also includes a structure of closed cells extending between the heating film or cloth and the outside face of the sole.

5 Claims, 2 Drawing Sheets

HEATED SHOE WITH LONG HEATING TIME

The invention relates to heated shoes.

BACKGROUND OF THE INVENTION

Heated shoes, in particular heated town shoes are known. In particular, document FR-A-2 365 973 describes a shoe comprising a heating resistance element disposed in the front portion of the sole, said resistance element being powered with electricity from a rechargeable battery housed in a cavity in the heel.

In such a shoe, a considerable fraction of the heat produced by the resistance element is dissipated through the face of the sole which is in contact with the ground. The quantity of energy consumed by the element is thus excessively large in comparison with the heat actually delivered to the user. In practice, this means that the heating time of the battery is very short, thereby considerably reducing the advantage of this type of shoe.

In addition, a conventional heating resistance element delivers heat at specific locations on the sole, i.e. along the resistance element. The temperature difference between neighboring points on the sole can then sometimes be uncomfortable.

The state of the art relates also to various electrical resistance element heating systems for ski boots (reference may be made in particular to documents EP-A-0 084 789, EP-A-0 315 004, EP-A-0 205 110, and EP-A-0 433 523). In those systems, heat distribution is generally irregular and limited to the immediate environment of the heating resistance element.

To complete the state of the art, reference may also be made to the following documents: DE-A-3 323 062, FR-A-1 164 720, FR-A-722 487, and U.S. Pat. No. 5,367,788.

OBJECTS AND SUMMARY OF THE INVENTION

An object of the invention is to provide a heated shoe having a heating time that is much greater than that of the shoe of the above-specified type, and providing a better distribution of heat over the sole.

The invention thus provides a heated shoe comprising a heel, a sole provided with a heating device and having an outside face for making contact with the ground, and at least one energy-providing battery located in the heel and connected to the heating device.

According to the invention, the heating device comprises a heating film or cloth extending over at least a portion of the sole parallel to its outside face, and the sole also includes a structure of closed cells extending between the heating film or cloth and the outside face of the sole.

The structure of closed cells, e.g. filled with air, provides highly effective thermal insulation from the ground, considerably reducing loss of heat through the outside face of the sole. Ground heat losses are thus minimized and most of the energy from the battery is converted into heat which is actually transmitted to the user. This has the effect of increasing the running time of the battery.

Preferably, the heating film or cloth includes two electrodes connected to respective poles of the energy-providing batteries, e.g. via tinned copper braids.

In an advantageous version of the invention, the heating film or cloth extends over the portion of the shoe corresponding to the toes and to three metatarsals. The heating film or cloth thus produces heat for those portions of the foot that need to be heated in priority, and it does so with excellent uniformity.

In certain preferred embodiments, an aluminum plate or sheet is placed beneath the heating film or cloth to provide uniform and comfortable distribution of heat within the sole.

BRIEF DESCRIPTION OF THE DRAWINGS

Other characteristics and advantages of the invention appear further from the following description of preferred embodiments. In the accompanying drawings given by way of non-limiting example.

MORE DETAILED DESCRIPTION

Figure 1:
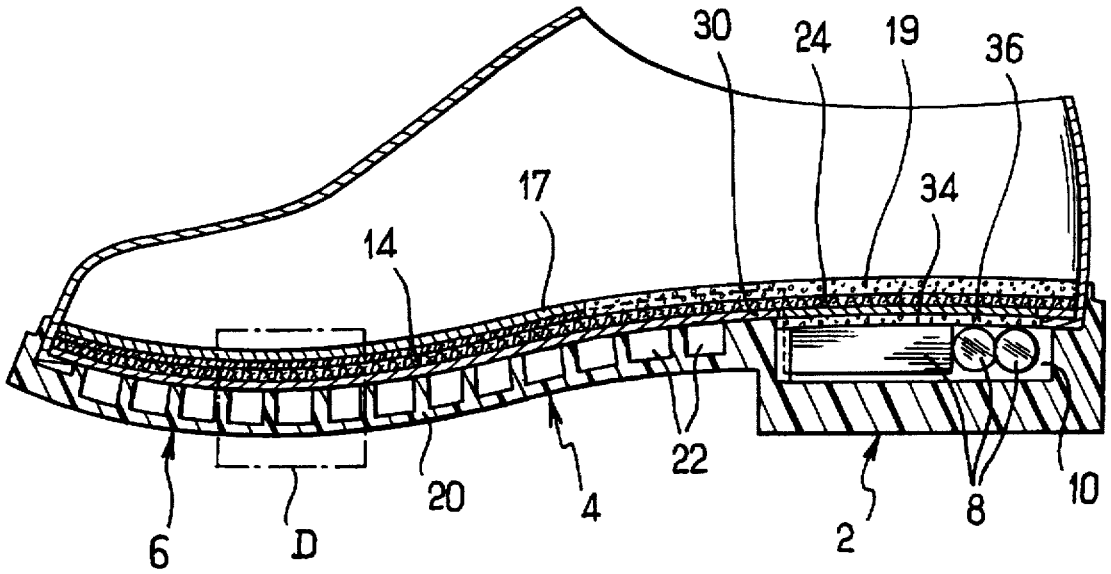
FIG. 1 is an elevation view in longitudinal section showing a shoe of the invention constituting a first embodiment.
Figure 2:
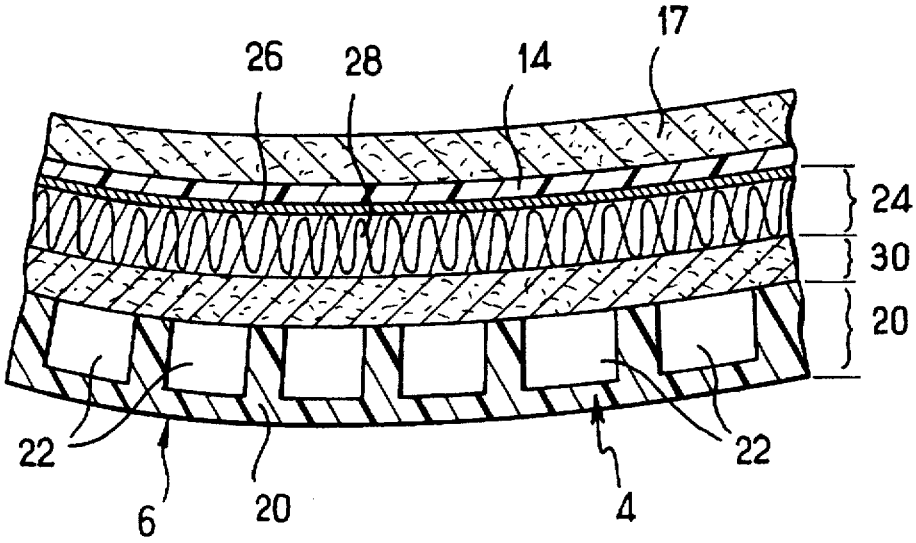
FIG. 2 is a view on a larger scale of detail D in FIG. 1.
Figure 3:
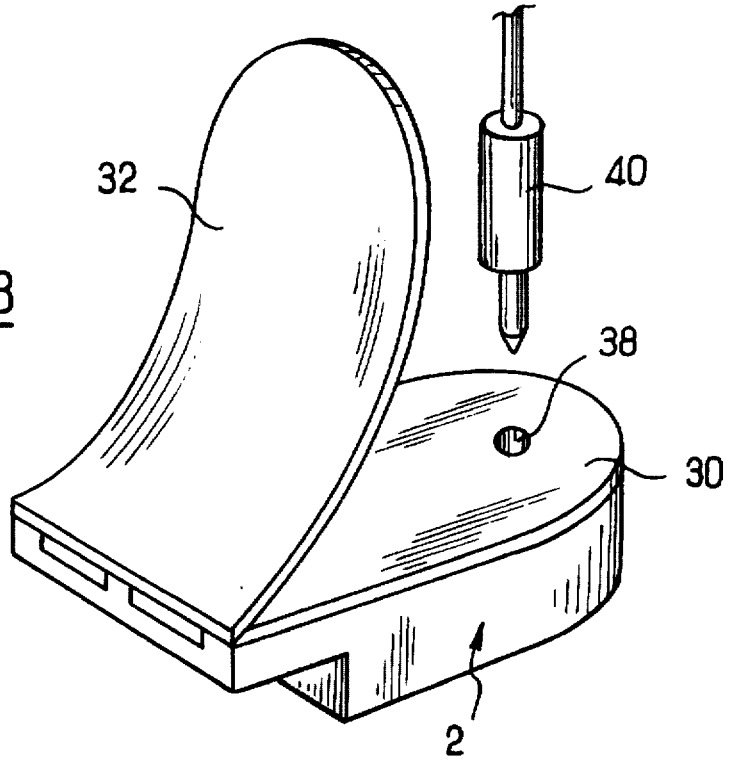
FIG. 3 is a fragmentary perspective view showing the rear portion of the sole support, together with a raisable portion providing access for a power supply plug.

The heated shoe shown in FIGS. 1 to 3 is of the leisure or town type shoe. It comprises a heel 2 and a sole 4 extending over the heel so that the sole extends in conventional manner from one end of the shoe to the other. The sole 4 has an outside face 6 with a portion that is designed to make contact with the ground. Below, the "front" of the shoe means the portion of the shoe that is remote from the heel, whereas the "back" of the shoe means the portion close to the heel.

The sole 4 is provided with a heater device described in detail below. The shoe includes five batteries 8 for providing electrical energy, which batteries are disposed in a rigid box (not shown) placed in a reinforced housing 10 in the heel and having an opening facing the sole 4. The batteries 8 are connected to the heater device via a special tinned copper braid for avoiding any breakage during the flexing to which the sole is subject. By way of example, it is possible to use five 1.5 volt batteries.

Figure 4:
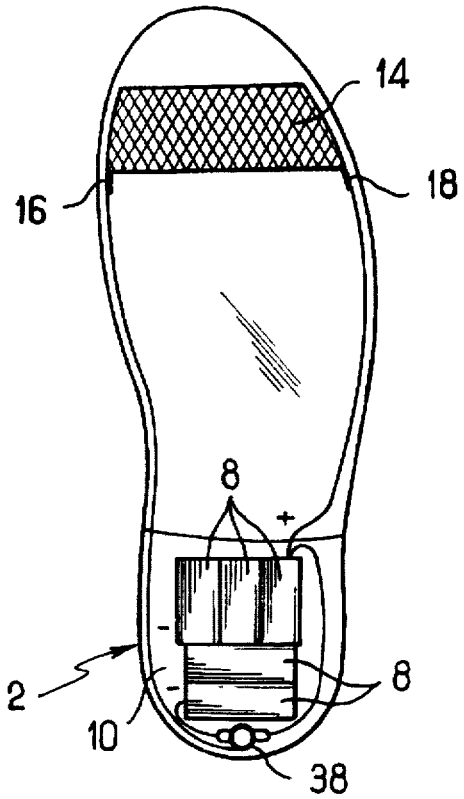
FIG. 4 is a diagram showing the connections of the heating film or cloth and a second embodiment of the shoe demonstrating another disposition for the film or cloth.

In the embodiment shown in FIGS. 1 and 2, the heater device comprises a heating film or cloth 14 extending over the front portion of the sole parallel to its outside face 6. In the embodiment shown in FIG. 4, the heating film or cloth 14 extends over the portion of the shoe that corresponds to the toes and to three metatarsals, which corresponds essentially to portion of the foot that requires heating, with the film or cloth providing excellent uniformity in the heating provided.

By way of example, the heating film or cloth 14 can be made of polyester with integral heater elements, the film or cloth being electrically connected to two electrodes 16 and 18. The electrodes 16 and 18 are connected to respective poles of the assembly constituted by the power supply batteries 8 connected in series, by means of respective associated braids of tinned copper, with this type of connection being highly suited to withstanding the flexing of the sole.

A leather portion of the sole 17 that is designed to come into contact with the foot of the user overlies the heating film or cloth 14 inside the shoe. The heating film or cloth 14 and the sole portion 17 are extended throughout the rear portion of the shoe by means of a layer of synthetic foam 19.

The sole also includes a structure 20 having cells 22 extending between the heating film or cloth 14 and the outside face 6 of the sole. The cells 22 are uniformly distributed throughout the structure 20. By way of example, about one-fourth of the volume of the structure 20 is constituted by the volume of the cells 22. The structure 20 is made of a synthetic material such as a synthetic rubber.

The sole 4 also includes an additional layer of thermal insulation 124 comprising a metal sheet 26 that is preferably constituted by aluminum disposed on a non-woven layer 28 which extends between the heating film or cloth 14 and a sole support 30 which closes the tops of the cells 22 in the cellular structure 20, thereby imprisoning a certain volume of air in each cell. Optionally, the metal sheet 26 may be covered in cloth or foam. In this case, the additional layer 24 extends so as to cover the heel.

The sole 4 thus comprises a sole support 30, often known as an "insole", of conventional type extending between the cellular structure 20 and the additional layer 24 and which extends so as to overlie the heel 2. Over the heel 2, the sole support 30 has a trap door 32 (see FIG. 3) to provide access to a female power supply socket 38 housed in the heel so as to enable the batteries 8 to be recharged by means of a conventional battery charger plug 40 (male plug) that is mains-powered. The female socket 38, situated behind the batteries, advantageously also acts as a switch: when the charger plug is engaged therein (i.e. the male plug 40), it switches off heating and enables the batteries 8 to be charged.

Inside the reinforced housing 10, a removable layer of foam 36 (visible in FIG. 1 but not shown in FIG. 3) extends to cover and protect the batteries 8 and the female socket 38, which are preferably disposed in a protective box made of rigid plastics material (e.g. polypropylene).

The film or cloth 14 powered via the electrodes 16 and 18 produces heat which is transmitted to the foot of the user through sole portion 17. The cellular structure 20 and the insulating layer 24 prevent large amounts of heat being lost towards the outside face 6.

The foam layer 19 and the thermal insulation layer 24 are removable to give access to the trap door 32.

Naturally, numerous modifications and improvements could be applied to the invention without going beyond the ambit thereof. Apart from the relative positions of the heating film or cloth, the cellular structure, and the outside face, it is also possible to modify at will the number, the disposition, and the dimensions of the various layers making up the sole. In particular, it is possible to dispose certain layers in the front and/or the back portion of the sole. Also, one or more layers could be disposed between the cellular structure and the outside face of the sole. Finally, the number of power supply batteries may be different.

It would also be possible to provide a trap door giving access to the batteries in the heel with the trap door being accessible by raising the inside sole.

The heating shoe described above could be intended more particularly for use as a town shoe, as a leisure shoe, or as a sports shoe.

I claim:

1. A heated shoe comprising a heel, a sole provided with a heating device and having an outside face for making contact with the ground, and at least one energy-providing battery located in the heel and connected to the heating device, wherein:

the heating device comprises a heating fabric extending over at least a portion of the sole parallel to the outside face thereof, said heating fabric further including two electrodes which are connected by respective tinned copper braids to respective poles of said at least one energy-providing battery;

the sole includes (i) an additional thermal insulation layer comprising a metal sheet disposed on a non-woven layer, said insulation layer extending between the heating fabric and a sole support that extends as far as the heel and (ii) a cellular external structure extending between the sole support and the outside face of the sole, said cellular structure including cells having their tops closed by said sole support;

a reinforced housing is provided in the heel for receiving said at least one energy-providing battery, said housing having an opening that faces the sole, and the above sole support further presents a trap door to give access to a female power supply socket received in the heel to enable said at least one battery disposed in said housing to be recharged.

2. A heated shoe according to claim 1, wherein the heating film or cloth extends over a portion of the shoe corresponding to the toes and to three metatarsals.

3. A heated shoe according to claim 1, wherein the closed cells are filled with air.

4. A heated shoe according to claim 1, wherein the additional insulation layer extends to the heel.

5. A heated shoe according to claim 1, wherein the tinned copper braids extend above the cellular structure.

* * * * *